United States Patent [19]

Berges et al.

[11] 4,180,085

[45] Dec. 25, 1979

[54] DISHWASHER FILL FLOAT

[75] Inventors: Jon F. Berges, Waynesville; James M. Woolley, Dayton, both of Ohio

[73] Assignee: White Consolidated Industries, Inc., Cleveland, Ohio

[21] Appl. No.: 957,666

[22] Filed: Nov. 3, 1978

[51] Int. Cl.[2] ..... B08B 3/02

[52] U.S. Cl. ..... 134/57 D; 73/306; 137/387; 137/429; 200/84 R

[58] Field of Search ..... 134/56 D, 57 D; 68/207; 73/306; 137/387, 429; 200/84 R

[56] References Cited

U.S. PATENT DOCUMENTS

| | | | |
|---|---|---|---|
| 3,464,437 | 9/1969 | Zane | 137/387 |
| 3,610,271 | 10/1971 | Jarvis | 134/57 D X |
| 3,643,681 | 2/1972 | Simmons | 137/429 |
| 3,829,636 | 8/1974 | Scott | 134/57 D X |
| 3,832,870 | 9/1974 | Todd-Reeve | 134/57 D X |
| 3,835,880 | 9/1974 | Hoffman et al. | 134/57 D X |
| 3,885,580 | 5/1975 | Cushing | 134/57 D |
| 3,894,555 | 7/1975 | Payne | 134/57 D X |

*Primary Examiner*—Robert L. Bleutge

*Attorney, Agent, or Firm*—Pearne, Gordon, Sessions

[57] ABSTRACT

An improved float assembly for a dishwasher liquid fill system includes cam means on the float stem. The cam includes a first portion operative, upon the liquid rising to its normal fill level, to maintain a switch in its circuit closing position allowing the fill valve to be opened at selected intervals during the operational cycle. Upon the float being buoyed upwardly by the liquid level rising above its normal-fill level to an over-fill level the cam means is operative to retain the float at an elevated position permitting the dishwasher to complete its operational cycle after which the float may be manually reset to its lower position to again permit normal operation of the dishwasher.

1 Claim, 7 Drawing Figures

DISHWASHER FILL FLOAT

This invention relates to a float assembly for a dishwasher and more particularly to a float assembly operative to establish a maximum or overfill liquid level within the washing chamber.

Float controls for liquid fill systems in dishwashers have been employed to control externally mounted overflow switches in response to a potential overflow condition. An example of one type of dishwasher float switch control is disclosed in co-pending U.S. patent application Ser. No. 949,210 to J. M. Woolley and J. F. Berges, assigned to the asignee of the present application. The Woolley et al patent application concerns a standpipe portion integral with the float support so as to be concealed within the float thereby providing an air bleed path to atmosphere via a float buoyancy and overflow cavity. Another example of a dishwasher float control assembly is disclosed in U.S. Pat. No. 3,643,681 to Simmons, also assigned to the assignee of the present application. The Simmons patent is directed to a float having a threaded engagement with the float support operative to rotate the float as the changing liquid level rises and lowers relative to the standpipe to achieve a turbulence-dampened float control.

It is an object of the present invention to provide an improved float and fill switch assembly for a dishwasher which includes cam means on the float stem operative to establish a predetermined float elevated position upon the float being buoyed upwardly by the liquid level rising from a normal-fill level to an over-fill level.

It is a further object of the invention to provide a float assembly as set forth in the preceding object wherein the cam means further includes a first cam portion operative, upon the liquid rising to its normal fill level, to contact the switch arm maintaining the switch in its circuit closing position allowing the fill valve to be opened at predetermined selected intervals during the operational cycle of the dishwasher to supply liquid to the chamber. Upon the liquid rising to its overfill level the float is buoyed upwardly to said predetermined elevated position causing the first cam portion to be moved out of contact for moving the element and whereby the switch is switched to its circuit opening position shutting off additional liquid flow to the chamber while the dishwasher completes its operational cycle.

Still another object of the invention is to provide an improved float assembly whereby upon completion of the dishwasher operation cycle, the float may be manually rotated relative to its support causing a second cam portion of the cam means to contact the switch arm and return same to its first position allowing downward movement of the float to its rest position closing the circuit to the water fill valve to again permit normal operation of the dishwasher.

Further objects and advantages of the present invention will be apparent from the following description, reference being had to the accompanying drawings wherein a preferred embodiment of the present invention is clearly shown.

Figure 1:
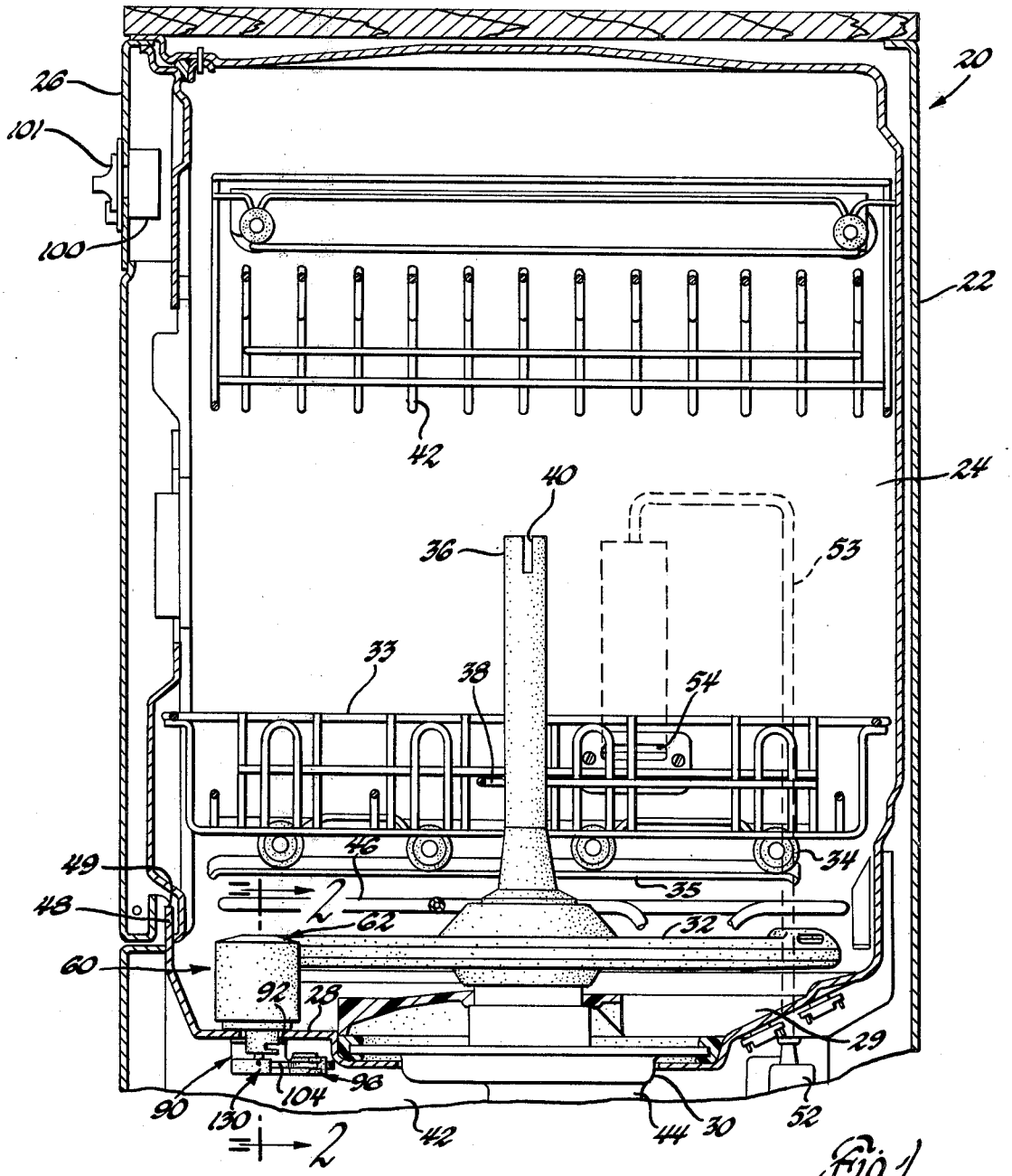
FIG. 1 is a view in vertical section of a dishwasher including the float assembly of the present invention.

For the purpose of illustrating the present invention, there is shown in FIG. 1 a dishwasher illustrated generally at 20. The dishwasher 20 is comprised of casing means 22 defining a dishwashing chamber 24 closed at the front thereof by dishwasher door 26 and having a bottom wall 28 forming a depressed tub sump or liquid container 29 leading to a pump motor assembly 30 which is of a conventional type such as shown in U.S. Pat. No. 3,265,311 issued Aug. 9, 1966, for example. In general, the water distribution system includes a revolvable spray arm 32 beneath the lower rack 33 with the rack supported on rollers 34 operating on a pair of tracks, one of which is shown at 35. A rotating spray column or spray tube 36 is affixed to the spray arm and extends upwardly through a guard portion 38 of the lower rack 33. The spray tube has an outlet 40 adapted to project a spray generally upwardly through the support wire network of an upper dishrack 42. A reversible motor 44, in the pump motor assembly 30, directly drives the pump in one direction to recirculate the water for washing or rinsing, and, when reversed pumps the water to drain. A heater 46 provides recovery heat to wash and rinse water and for adding heat to the chamber for the drying cycle.

Figure 2:
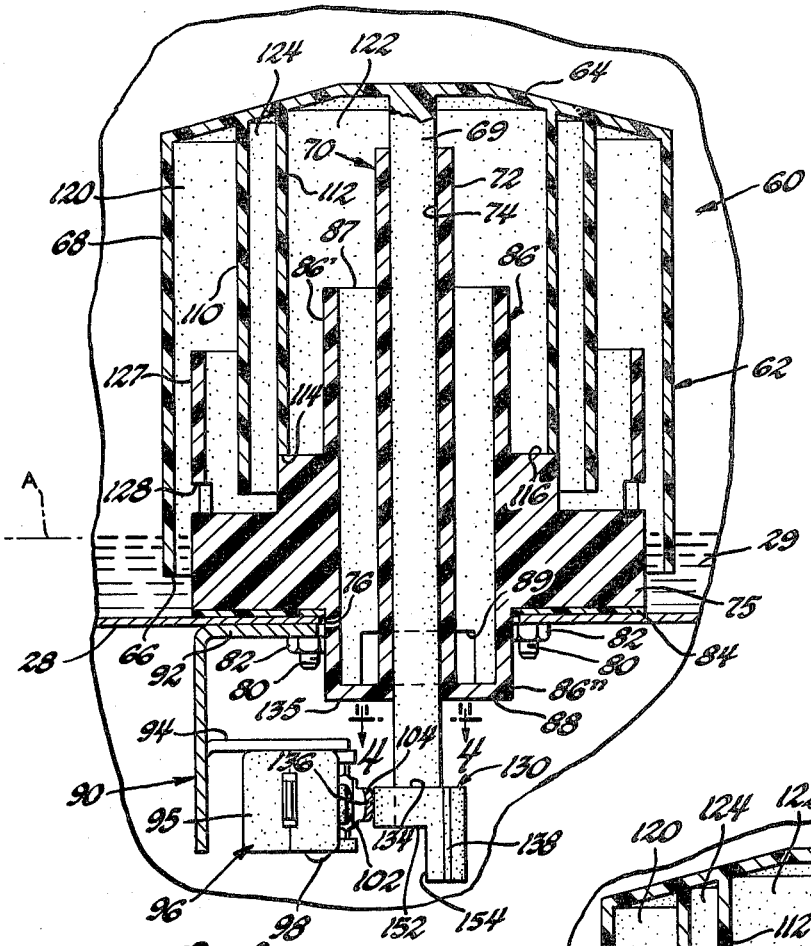
FIG. 2 is an enlarged fragmentary vertical sectional view of the float assembly with the float in its lower normal position.
Figure 4:
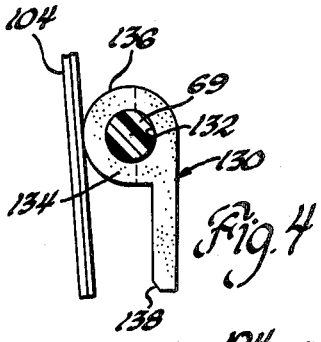
FIG. 4 is a schematic-like fragmentary horizontal sectional view taken on line 4—4 of FIG. 2 showing the float camming arrangement in its normal-fill position.

The dishwasher sump 29 is sized to contain a predetermined quantity of liquid which in the disclosed form is about 2.7 gallons of water standing in a quiescent state at normal fill level indicated at "A" in FIG. 2. The sump 29 is formed with a raised ledge or wall 48 defining along with the upper edge 49 thereof a maximum or potential overflow level, within the range of 4.5 to 5 gallons for the disclosed form, at which the sump could reach its capacity before spilling or overflowing outside the dishwasher cabinet.

Water is supplied to the sump 29 by means of a solenoid actuator water fill valve 52 (FIG. 1) which controls the flow of liquid through supply pipe, indicated by dashed lines at 53, and then through an opening 54 to the dishwashing chamber 24 leading to the sump. Specifications for a typical dishwasher for fill valve 52 call for a supply of water at a rate of about 1.6 gallons per minute from a domestic water supply source having supply pressures ranging between a minimum of about 20 pounds per square inch (psi) to a maximum of about 120 psi.

In the above-described dishwasher 20, it is customarily desired to stop the inflow of liquid when the water reaches the predetermined level A within the sump 29. Frequently, it is desired that a fill control operates satisfactorily even when the pump is in operation circulating liquid in the dishwashing chamber. The present invention provides a flow control assembly for this purpose designated generally by the reference numeral 60.

Figure 3:
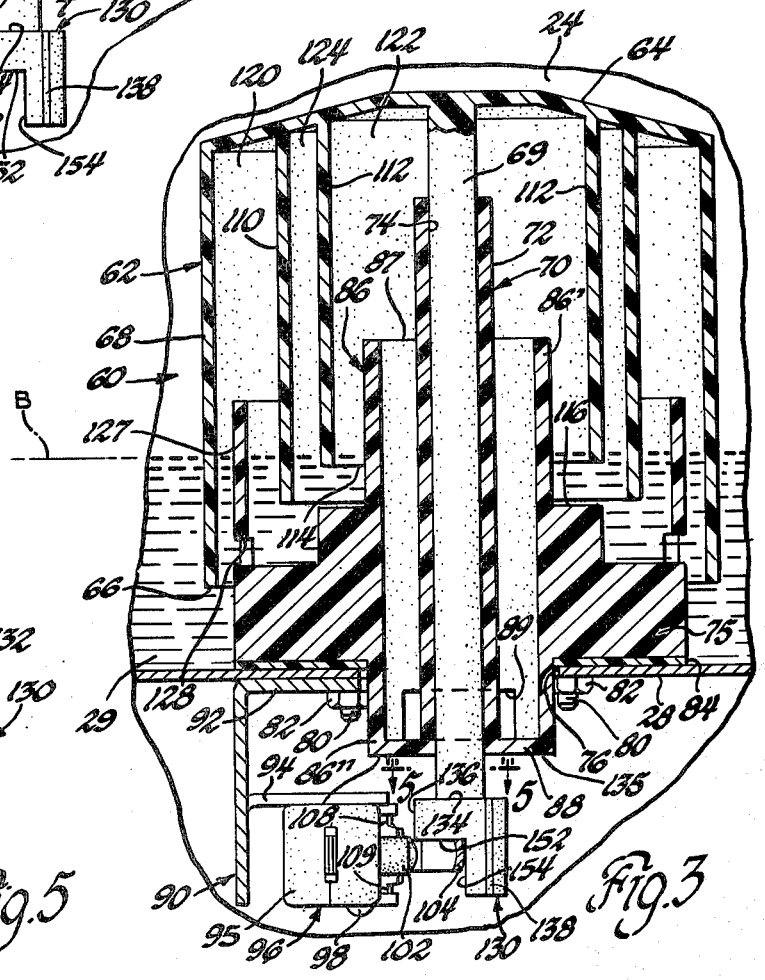
FIG. 3 is a view similar to FIG. 2 showing the float in its fixed raised overfill position.

The flow control assembly 60 includes a float generally indicated at 62 which in the disclosed embodiment is in the general form of an inverted cup. The float cup may be formed with a suitable lightweight plastic material such as polypropylene, for example. As best seen in FIGS. 2 and 3, the float includes a closed top wall 64, a downwardly facing open bottom 66 and slightly conical side wall 68. The float top wall 64 interconnects to a downwardly extending elongated central control actuating rod or stem 69 located on the principal axis of the float 62.

The float support, generally indicated at 70 in FIGS. 2 and 3, includes a central elongated sleeve 72 having a bore 74 therethrough dimensioned for slidable reception of the float stem 69. The float support 70 is shown mounted on the sump bottom wall 28 by means of an outwardly extending circumferential stepped disc or base 75 positioned concentrically over a circular opening 76 in the sump bottom wall 28. The base 75 has a plurality of circumferentially-spaced threaded studs 80, which in the disclosed form are four in number, embedded therein and positioned to extend axially through aligned apertures in the bottom wall 28 so as to threadably receive nuts 82 thereon. Tightening of the nuts 82 compresses an annular resilient gasket 84 and sealingly secures the base 75 against the sump bottom wall 28.

The float support 70 includes a hollow central standpipe 86 concentrically arranged about the sleeve 72 having an upper portion 86' defining a ring-like water entrance 87 and a lower portion 86" having a closed bottom wall 88 with an exit aperture 89 formed in the side wall of the standpipe lower portion 85". It will be noted in FIGS. 2 and 3 that lower portion overflow exit aperture 89 is located a predetermined distance below the sump bottom wall 28 and the standpipe upper entrance 87 is located a predetermined overflow height above the quiescent water surface level "A".

Figure 1A:
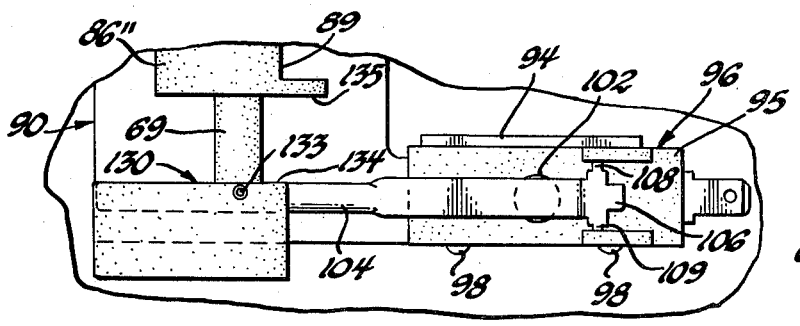
FIG. 1A is an enlarged fragmentary elevational view of the float switch assembly of FIG. 1.

As seen in FIGS. 1A, 2 and 3, and L-sectioned switch mounting bracket, indicated generally at 90, has its horizontal flange 92 suitably secured to the underside of the sump wall as by means of a pair of threaded studs 80 extending therethrough and retained by nuts 82. The L-shaped bracket has a lower lanced-out flange 94 positioned to support switch housing 95 containing switch means by suitable fasteners such as machine screws 98.

In the preferred embodiment the switch means is a sensitive single throw-single pole normally-open microswitch 96 connected in the dishwasher electrical control circuit (not shown) including electrically-powered sequence control or timer means, generally indicated at 100 in FIG. 1, operated by a manual rotary control 101. The microswitch 96 is located in the control circuit such that upon closure it completes a circuit between an electrical power supply and the fill valve 52. The switch 96 is provided with an operating plunger button or switch actuator 102 spring biased outwardly for reciprocal movement in a horizontal plane. An actuator engaging element in the form of arm 104 has one end 106 (FIG. 1A) pivotally connected to the switch housing 95 so as to pivot about vertically aligned pivot trunnions 108, 109 in the horizontal plane defined by the reciprocal axis of switch button 102. It will be noted that the float rod 69 is of a length such that it telescopes through the sleeve bore 74 so as to be reciprocally guided thereby for vertical movement adjacent the midportion of arm 104.

As seen in FIGS. 2 and 3, the interior of the float 62 is divided into a plurality of separate chambers or cavities by means of outer float side wall 68, first internal wall means in the form of a vertically extending cylindrical outer wall section or partition 110 concentrically disposed about the stem 69 and integrally molded with the float so as to depend from the closed top wall 64 of the float. Second internal wall means, in the form of vertically extending cylindrical inner wall section or partition 112, is concentrically disposed about the stem 69 and integrally molded with the float in the same manner as outer wall section 110. It will be noted that in FIG. 2 with the float in its normal lower or rest position that lower edge 114 of inner wall section 112 contacts the stepped upper surface 116 of the base 75 to provide a normal rest or support position for the float 62.

The float inner wall section 112 and the outer wall section 110 divide the float interior into a plurality of circumferential or ring-like cavities, shown at 120 and 124, adapted to entrap air to provide buoyancy for the float upon the liquid level rising in the sump to a predetermined water overfill level "B". An inner overflow cavity, indicated at 122, is of a predetermined size to telescopically receive in symmetrical fashion therein the upper portion 86' of the standpipe 86. The float support 70 includes a cylindrical wall section or base partition 127 provided with outlet or drain apertures 128 which allow water to escape from the partitioned area after an overfill condition.

Turning now to FIGS. 1A and 4–6 wherein applicants' cam means, generally indicated at 130, is shown suitably secured on the lower or free end of the stem 69. The cam means 130 in the disclosed embodiment is a separate cam member having a through bore 132 so as to be received in press-fit telescopic relation on the bottom end of stem 69 and secured thereto by suitable means such as by a tapered cross or through pin 133. The cam means 130 provide an upper stop shoulder 135 operative to engage the undersurface 135 of sleeve bottom wall 88 to define the uppermost limit or travel of the float 62.

The cam means 130 includes first and second cam portions 136 and 138 respectively. In the disclosed embodiment the first cam portion 136 is in the form of an arcuate cam surface substantially concentric with the stem 69 with the cam surface 136 oriented so as to contact the actuator engaging element or arm 104 intermediate its pivoted end 106 and its free end. The first cam portion 136 is contoured to contact the switch element or arm 104 when the liquid level in the sump is at or below the normal fill level "A", as seen in FIG. 2, for moving the switch arm 104 to a first position (FIGS. 1A, 2 and 4) and maintaining the actuator or button 102 in its circuit closing position. In the disclosed embodiment the button 102, shown in FIG. 2, which is normally biased in an outer FIG. 4 position, is pressed inwardly within the switch housing 95. With the switch button 102 depressed the microswitch 96 is closed so as to allow the opening of the dishwasher fill valve at predetermined selected intervals of the sequence control means 100 during the operational cycle of the dishwasher to supply water to the dishwashing chamber sump area 29.

Upon the liquid or washing fluid rising in the washing chamber to an overfill level indicated at "B" in FIG. 3, caused by an excess amount of water being dispensed into the chamber. Such an overfill condition may arise as by an abnormal flow of water through the inlet valve caused by a malfunctioning of the control system. It will be noted, however, that if the water level is maintained at or below the normal fill level "A" the float 62 remains in its rest or lowered position shown in FIG. 2 with the inner wall means edge 114 contacting the base step 116. Upon the water level rising a predetermined amount above surface "A", the outer buoyancy chamber or cavity 120 entraps air therein whereby the float 62 attains sufficient buoyancy causing it to rise vertically guided by the stem 69 within the sleeve bore 74. Upon the float rising to a predetermined vertical height, the first cam portion 136 is moved out of contact with the switch element or arm 104. This results in the actuator button being free to move to its outer biased (FIG. 3) switch open position, thereby preventing additional water flow to the chamber 24 by open-circuiting the solenoid 52 controlling the inlet valve. The overfill water level within the sump is substantially at the surface level "B" permitting the sequence control means 100 to advance the dishwasher through the remainder of its operational cycle.

Figure 5:
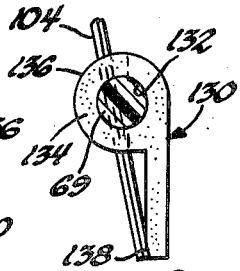
FIG. 5 is a view similar to FIG. 4 taken on line 5—5 of FIG. 3 showing the float in its overfill position.

As seen in FIGS. 3 and 5, the movement of the actuator button 102 to its outer position is operative to move the arm 104 to its FIG. 5 position where arm 114 pivots so as to extend beneath the cam means 130 so as to engage horizontal or lower shoulder 152 formed by a notched-out portion 154 of the cam means. Thus, the stem 69 is locked in its FIG. 3 position thereby preventing downward movement of the float 62.

Figure 6:
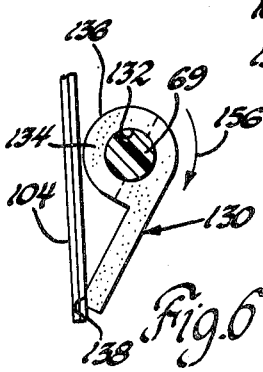
FIG. 6 is a view similar to FIG. 5 showing the resetting position of the cam means.

Upon completion of the operation cycle of the dishwasher the float 62 is manually rotated in a predetermined direction, shown by arrow 156 in FIG. 6 for the instant form, relative to the float support guide sleeve. As seen in FIG. 6, with the float rotated in the clockwise direction of arrow 156 the second cam portion 138 contacts the switch arm 104 and pivots the arm to its FIG. 4 or first position, allowing the float 62 to be returned to its first or lower rest position of FIG. 2. With the float 62 again in its first or lower rest position the switch element or button 102 is again contacted by the first cam portion 136 causing the button 102 to be retracted to its second inner position (FIG. 1), again closing the dishwasher circuit to the fill valve solenoid wherein the dishwasher is ready for the start of a new wash cycle.

While the embodiment of the present invention as herein disclosed constitutes a preferred form, it is to be understood that other forms might be adopted.

The embodiments of the invention in which an exclusive property or privilege is claimed are defined as follows:

1. In an automatic dishwasher including a dishwashing chamber having a bottom wall portion forming a sump, an electrically-operated inlet valve for supplying liquid to the chamber to a predetermined normal-fill level in the sump, an electrical circuit including electrically-powered sequence control means for operating the dishwasher in accordance with a predetermined operational cycle, a switch electrically connected by said circuit to the inlet valve, said switch including an actuator normally being resiliently biased in a first position opening the circuit to prevent energization of said inlet valve, said actuator being movable to a second position closing the circuit to permit energization of said inlet valve, a float assembly for said fill valve including a float in the form of an inverted cup including a closed top with an elongated stem extending from said closed top on the principal axis of said float; said float operative to remain at a first lower rest position with said liquid at said normal-fill level, said float adapted to be buoyed upwardly upon the liquid level rising above said normal-fill level to a predetermined overfill level, a float support guide sleeve mounted on the bottom wall portion of said sump, said float stem dimensioned for slidable reception in said sleeve, said sleeve operative for guiding said float substantially in a predetermined linear path perpendicular to the liquid surface, the improvement comprising; cam means adjacent the free end of said stem operative to engage said guide sleeve to establish a float maximum elevated position upon said float being buoyed upwardly by the liquid level increasing above said normal fill level to said overfill level, said cam means including first and second cam portions, an actuator engaging element movably mounted on said switch, said first cam portion contoured to contact said element when said liquid level in said sump is at or below said normal-fill level for moving said element to a first position holding said actuator in its circuit closing position allowing the opening of said fill valve at predetermined selected intervals by said sequence control means during said operational cycle to supply liquid to said chamber, upon the liquid rising to said overfill level said float being raised to said elevated position causing said first cam portion to be moved out of contact for moving said element, whereby said actuator is free to move to its circuit opening position shutting off additional liquid flow to said chamber while permitting said sequence control means to operate said dishwasher through the remainder of its operational cycle, and wherein the movement of said actuator to its circuit opening position being operative to move said element to a second position preventing downward movement of said float, upon completion of said operation cycle said float being manually rotatable in a predetermined direction relative to said float support guide sleeve causing said second cam portion to contact said element and move same to its first position resulting in downward movement of said float to its first lower rest position, and whereby by virtue of said float being in said first lower rest position said element is again contacted by said first cam portion causing said actuator to be held in said second position closing said circuit to said valve.

* * * * *